US010570701B2

(12) United States Patent
Robinson et al.

(10) Patent No.: US 10,570,701 B2
(45) Date of Patent: Feb. 25, 2020

(54) SYSTEM AND METHOD FOR ACTUATING MULTIPLE VALVES

(71) Applicant: Cameron International Corporation, Houston, TX (US)

(72) Inventors: Stuart Robinson, Katy, TX (US); Delbert Edwin Vanderford, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 148 days.

(21) Appl. No.: 15/461,219

(22) Filed: Mar. 16, 2017

(65) Prior Publication Data

US 2018/0266214 A1 Sep. 20, 2018

(51) Int. Cl.
*E21B 41/00* (2006.01)
*E21B 34/02* (2006.01)

(52) U.S. Cl.
CPC ..... *E21B 41/00* (2013.01); *E21B 34/02* (2013.01)

(58) Field of Classification Search
CPC ..... E21B 41/00; E21B 34/02; E21B 41/04; E21B 7/12
See application file for complete search history.

(56) References Cited

U.S. PATENT DOCUMENTS 3,099,316 A 7/1963 Johnson
3,777,812 A * 12/1973 Burkhardt ..... E21B 41/04 166/338
2004/0135112 A1* 7/2004 Greeb ..... E21B 34/02 251/214
2009/0045365 A1 2/2009 Stumbo et al.
2014/0060847 A1* 3/2014 Sunde ..... B63C 11/52 166/335
2017/0152723 A1* 6/2017 Deacon ..... E21B 34/02

OTHER PUBLICATIONS

PCT Search Report and Written Opinion for PCT/US2018/021921 dated Jun. 26, 2018; 12 pages.
Faria, et al.; "A Method for Autonomous Robotic Manipulation of Valves Using Visual Sensing"; 2nd IFAC Workshop on Automatic Control in Offshore Oil and Gas Production, May 27, 2015; pp. 227-234.
Anisi, et al.; "A Step-Wise Approach to Oil and Gas Robotics"; 2012 IFAC Workshop on Automatic Control Offshore Oil and Gas Production, May 31, 2012; pp. 48-52.
PCT International Preliminary Report; Application No. PCT/US2018/021921; dated Sep. 26, 2019; 9 pages.

* cited by examiner

*Primary Examiner* — Wei Wang
(74) *Attorney, Agent, or Firm* — Fletcher Yoder, P.C.

(57) ABSTRACT

A system includes a support structure that is configured to be positioned at a fixed location relative to a component of a mineral extraction system. The system also includes a drive assembly having a drive motor and a valve attachment, and the drive assembly is configured to move about the support structure and to actuate multiple valves of the component of the mineral extraction system.

19 Claims, 5 Drawing Sheets

SYSTEM AND METHOD FOR ACTUATING MULTIPLE VALVES

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are often employed to access and extract the resource. These systems may be located onshore or offshore depending on the location of a desired resource. Further, such systems generally include a wellhead through which the resource is extracted. A Christmas tree mounted above the wellhead may include a wide variety of components, such as valves, spools, and fittings that facilitate extraction, injection, and other operations. In some systems, each valve may include a separate actuator (e.g., manual, electric, hydraulic, or pneumatic actuator).

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
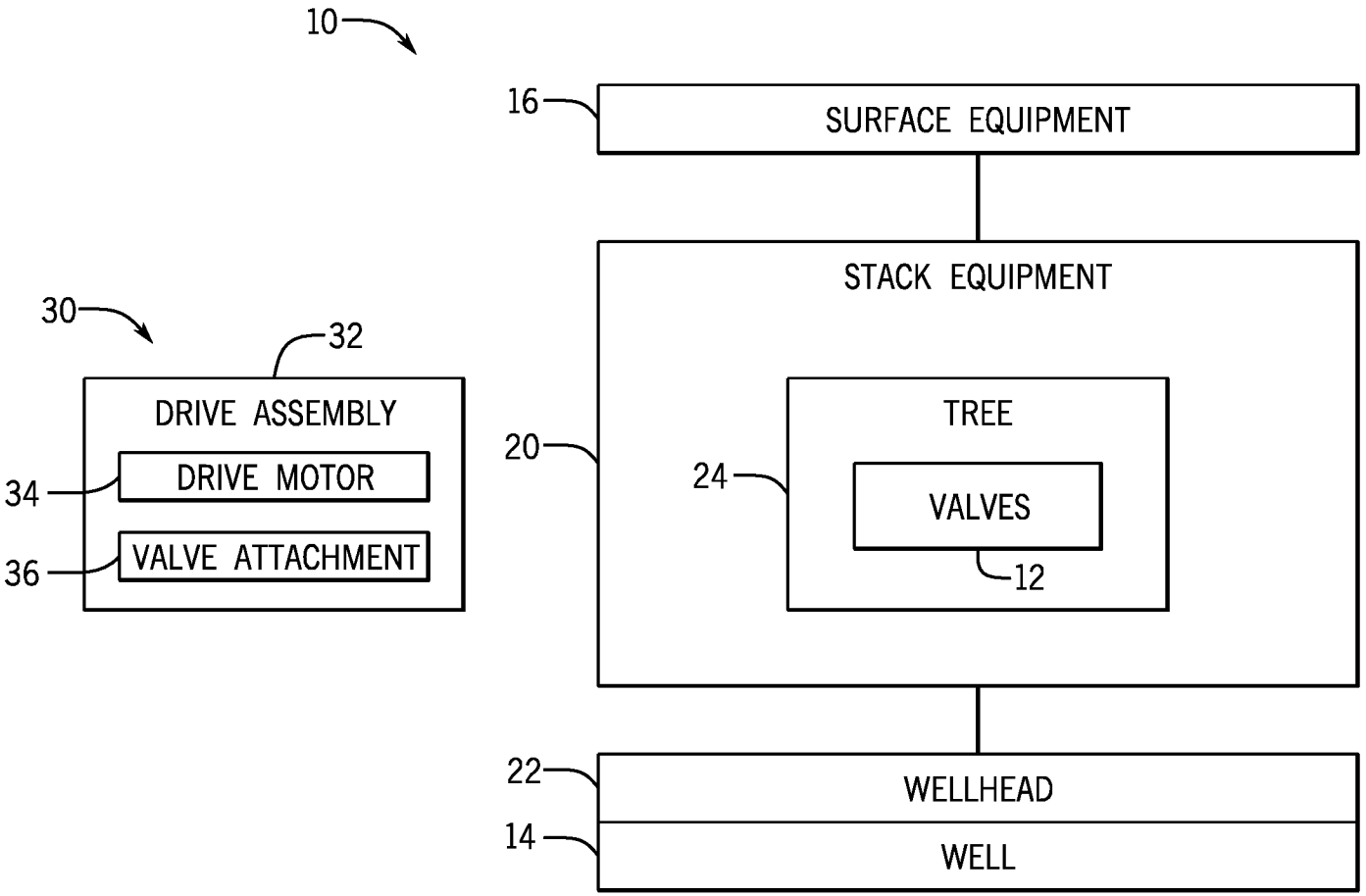
FIG. 1 is a block diagram of a mineral extraction system having multiple valves, in accordance with an embodiment of the present disclosure.

FIG. 1 illustrates an embodiment of a mineral extraction system 10 (e.g., hydrocarbon extraction system) having multiple valves 12 (e.g., choke valves, gate valves, ball valves, check valves, etc.). In the illustrated embodiment, the system 10 is configured to facilitate the extraction of a resource, such as oil or natural gas, from a well 14. As shown, the system 10 includes a variety of equipment, such as surface equipment 16 and stack equipment 20, configured to extract the resource from the well 14 via a wellhead 22. The surface equipment 16 may include a variety of devices and systems, such as manifolds, processing systems, treatment systems, pumps, conduits, valves, power supplies, cable and hose reels, control units, a diverter, a gimbal, a spider, and the like. As shown, the stack equipment 20 includes a production tree 24, also commonly referred to as a "Christmas tree." In the illustrated embodiment, the multiple valves 12 are provided within the tree 24 to control the flow of an extracted resource out of the well 14 and upward toward the surface equipment 16 and/or to control the flow of injected fluids into the well 14.

An actuator system 30 may include a drive assembly 32 (e.g., electric drive assembly, hydraulic drive assembly, or pneumatic drive assembly) having a motor 34 (e.g. electric motor, hydraulic motor, pneumatic motor, or drive motor) and a valve attachment 36 (e.g., rod, drive shaft, or the like) that is configured to transmit torque and/or thrust from the motor 34 to a corresponding component (e.g., a valve stem) associated with each of the multiple valves 12, thereby actuating the multiple valves 12 (e.g., adjusting the multiple valves 12 between open positions and closed positions). For example and as discussed in more detail below, the drive assembly 32 may be controlled (e.g., by an electronic controller) to actuate one of the multiple valves 12, and then the drive assembly 32 may be moved relative to the tree 24 (e.g., by sliding along a frame or a track) and controlled to actuate another one of the multiple valves 12. The actuator system 30 may include any suitable number of drive assemblies 32 (e.g., 1, 2, 3, 4, 5, 6, 7, 8, 9, 10, or more), and each drive assembly 32 may be configured to actuate any suitable number of the multiple valves 12 (e.g., 1, 2, 3, 4, 5, 6, 7, 8, 9, 10, or more).

While the multiple valves 12 are shown within the tree 24 in FIG. 1 to facilitate discussion, it should be understood that the multiple valves 12 disclosed herein may be located within any portion of the system 10, such as the surface equipment 16, other components of the stack equipment 20, and/or the wellhead 22. Thus, the drive assembly 32 may be utilized to actuate multiple valves 12 at any of a variety of locations about the system 10. While FIG. 1 illustrates a land-based system, it should be understood that the multiple valves 12 may be part of an offshore system, including part of subsea equipment (e.g., located below a sea surface and surrounded by sea water). For example, the multiple valves 12 may be part of a subsea production tree, a subsea manifold, a subsea blowout preventer, or other structure located at a sea floor. In such cases, the drive assembly 32 may be positioned subsea to actuate the multiple valves 12. Furthermore, it should be understood that the multiple valves 12 may be used to regulate any of a variety of fluids, such as any type of produced fluids, extracted fluids, supplied fluids, injected fluids, mud, water, steam, oil, gases, or the like, in any type of drilling and/or production system.

Figure 2:
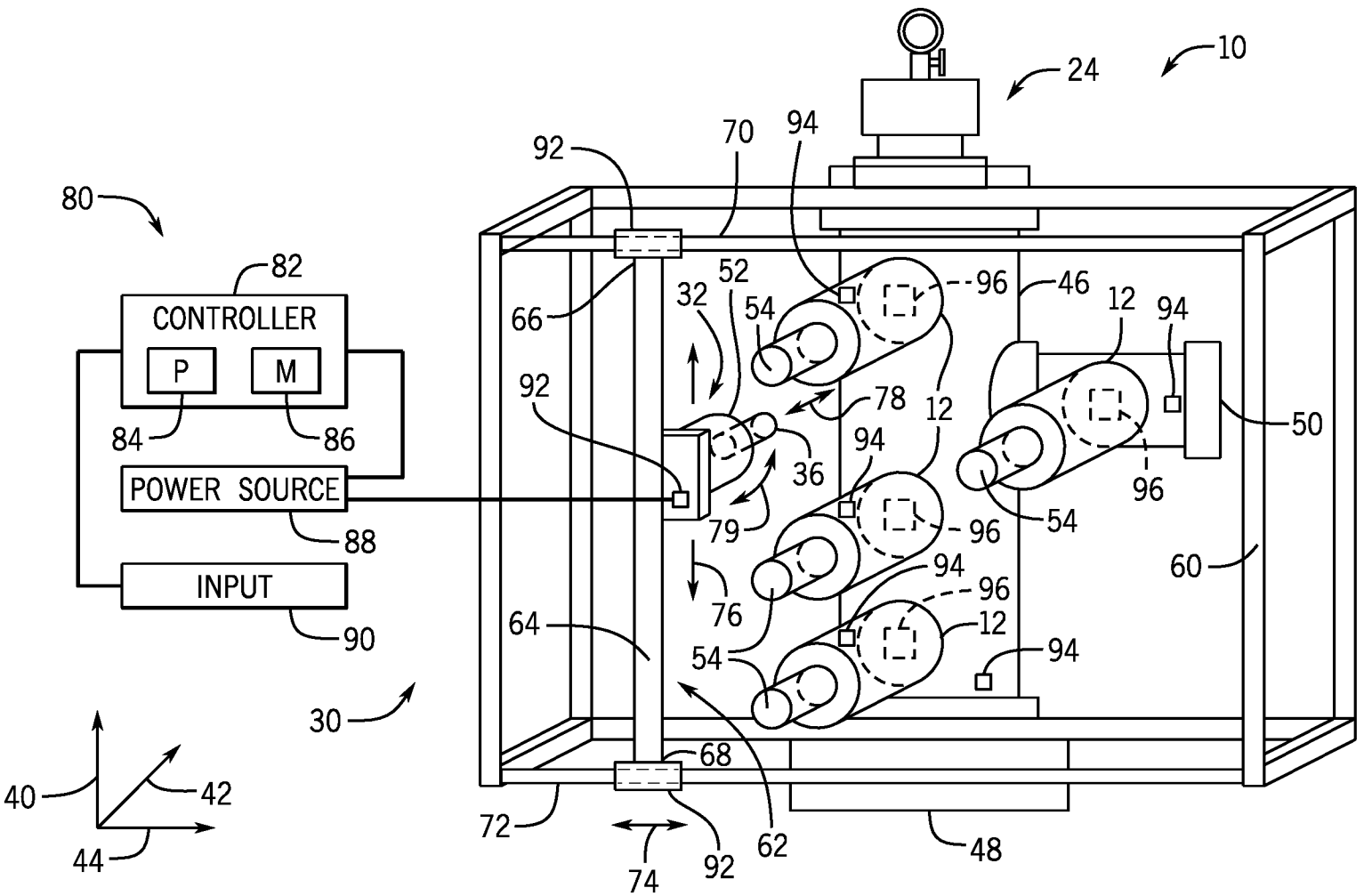
FIG. 2 is a perspective view of an embodiment of an actuator system having a drive assembly that may be utilized to actuate the multiple valves of FIG. 1.

FIG. 2 is a perspective view of an embodiment of the actuator system 30 that may be utilized to actuate the multiple valves 12. To facilitate discussion, the actuator system 30 and other components disclosed herein may be described with reference to a vertical axis or direction 40, a lateral axis or direction 42, and/or a longitudinal axis or direction 44.

In the illustrated embodiment, the multiple valves 12 are supported by a body 46 (e.g., housing or spool) of the tree 24 and are configured to adjust a flow of fluid through the body 46 of the tree 24. A first portion 48 (e.g., a first end or adapter) of the body 46 may be configured to couple to the wellhead 22 (shown in FIG. 1), and a second portion 50 (e.g., a second end or adapter) of the body 46 may be configured to couple to a conduit that extends toward downstream surface equipment (e.g., processing facilities or the like). The tree 24 may include any of a variety of valves 12. For example, the tree 24 may include a production valve configured to enable fluid flow to downstream processing equipment when in an open position and configured to block fluid flow to the downstream processing equipment when in a closed position, a master valve configured to adjust fluid flow from the well 14 through the tree 24, a kill wing valve configured to enable injection of fluids into the well 12 when in an open position, and/or a swab valve configured to provide access to the wellbore and/or to facilitate well maintenance when in an open position, for example. As discussed in more detail below, the multiple valves 12 may be electrically actuated valves, and some or all of the valves 12 may be fail-closed valves.

As shown, the drive assembly 32 includes a housing 52 (e.g., annular or cylindrical housing) that supports and surrounds the motor 34 (shown in FIG. 1), and the valve attachment 36 may extend from the housing 52 to enable the valve attachment 36 to engage a corresponding component 54 (e.g., a valve stem or shaft coupled to the valve stem) to actuate the multiple valves 12. To enable actuation of the multiple valves 12 with one drive assembly 32, the drive assembly 32 may be configured to move relative to the multiple valves 12. The actuator system 30 may include any of a variety of components to enable movement of the drive assembly 32 relative to the multiple valves 12. For example, in the illustrated embodiment, the actuator system 30 includes a frame 60 (e.g., a fixed frame, support structure, rails, or track) and a bracket 62 (e.g., a movable bracket or support structure) supported on the frame 60. The frame 60 may be in a fixed position relative to the multiple valves 12, and in certain embodiments, the frame 38 may contact and/or be supported by the tree 24. As shown, the bracket 62 includes a rod 64 that extends between a first end 66 and a second end 68, and the first end 66 is slidingly coupled to a first bar 70 of the frame 60 and the second end 68 is slidingly coupled to a second bar 72 of the frame 60 to enable the bracket 62 to move (e.g., slide) relative the frame 60 (as well as relative to the tree 24 and the multiple valves 12), as shown by arrows 74. In certain embodiments, the drive assembly 32 is supported by the bracket 62. In certain embodiments, the drive assembly 32 is slidingly coupled to the rod 64 of the bracket 62 to enable the drive assembly 32 to move relative to the bracket 62 (as well as relative to the frame 60, the tree 24, and the multiple valves 12), as shown by arrows 76. It should be understood that the actuator system 30 may be configured to enable movement of the drive assembly 32 in any of a variety of directions to actuate the multiple valves 12.

In operation, once the valve attachment 36 of the drive assembly 32 is aligned with the corresponding component 54 of one of the multiple valves 12 (e.g., once the drive assembly 32 reaches a target position along the vertical axis 42 and the longitudinal axis 44), power (e.g., electric power, hydraulic fluid, or pneumatic fluid) may be provided to the motor 34 to drive the valve attachment 36 toward and into engagement with the one of the multiple valves 12 in the lateral direction 46, as shown by arrow 78. The drive assembly 32 may be configured to actuate the multiple valves 12 via linear motion of the valve attachment 36 (e.g., in the direction of arrow 78), although it should be understood that in some embodiments, the drive assembly 32 may be configured to additionally or alternatively actuate the multiple valves 12 via rotational motion of the valve attachment 36 or other actuation component (e.g., in the direction of arrow 79).

As shown, the actuator system 30 may include a control system 80 that includes a controller 82 (e.g., electronic controller) having a processor, such as the illustrated microprocessor 84, and a memory device 86. A power supply 88 (e.g., alternating current source, direct current source, hydraulic fluid source, or pneumatic fluid source) may be configured to provide power to the motor 34. In some embodiments, the power supply 88 may be configured to provide power to a drive system (e.g., a motor) associated with the bracket 62 to drive movement of the bracket 62 relative to the frame 60, and/or to a drive system (e.g., motor) associated with the drive assembly 32 to drive movement of the drive assembly 32 relative to the bracket 62. For example, additional motors 92 (e.g., electric motors, hydraulic motors, or pneumatic motors) may be provided at various locations of the actuator system 30 to drive movement of the bracket 62 relative to the frame 60 and/or to drive movement of the drive assembly 32 relative to the bracket 62 to facilitate actuation of the multiple valves 12.

In some embodiments, the control system 80 may include an input device 90, which may include a switch, touch screen, or other device that enables an operator to provide an input (e.g., an instruction to move the drive assembly 32 to actuate one of the multiple valves 12, or the like). Thus, the operator may remotely control the drive assembly 32 to actuate the multiple valves 12. In some embodiments, the control system 80 may include one or more sensors 94 positioned about the system 10 (e.g., pressure sensors, temperature sensors, valve position sensors, fluid characteristic sensors, or the like), and signals generated by the one or more sensors 94 may be provided to the controller 82 to enable the controller 82 to determine an appropriate position for the drive assembly 32, to determine whether particular valves 12 should be adjusted (e.g., opened or closed), or the like. The controller 82 may then control the drive assembly 32 accordingly. For example, upon detection of certain fluid characteristics (e.g., characteristics of the fluid within the tree 24) by the one or more sensors 94, the controller 82 may control (e.g., automatically control in response to signals generated by the one or more sensors) the drive assembly 32 to actuate at least one of the multiple valves 12, such as to open at least one of the multiple valves 12 to enable fluid injection toward the well 14 and/or to enable fluid flow to the downstream surface equipment. In some embodiments, the controller 82 may be configured to actuate the multiple valves 12 according to a predetermined sequence (e.g., according to instructions stored in the memory 86). For example, upon receipt of certain operator instructions and/or certain sensor data and/or at certain times or stages of production, the controller 82 may automatically operate the drive assembly 32 to actuate a first valve of the multiple valves 12 and then operate the drive assembly 32 to actuate a second valve of the multiple valves 12 (e.g., at a predetermined subsequent time).

In certain embodiments, the controller 82 is an electronic controller having electrical circuitry configured to process signals, such as signals from the input device 90 and/or the one or more sensors 94. In the illustrated embodiment, the controller 82 includes the processor 84 and the memory device 86. The controller 82 may also include one or more storage devices and/or other suitable components. The processor 84 may be used to execute instructions or software. Moreover, the processor 84 may include multiple microprocessors, one or more "general-purpose" microprocessors, one or more special-purpose microprocessors, and/or one or more application specific integrated circuits (ASICS), or some combination thereof. For example, the processor 84 may include one or more reduced instruction set (RISC) processors. The memory device 86 may include a volatile memory, such as random access memory (RAM), and/or a nonvolatile memory, such as ROM. The memory device 86 may store a variety of information and may be used for various purposes. For example, the memory device 86 may store processor-executable instructions (e.g., firmware or software) for the processor 84 to execute, such as instructions for processing signals from the input device 90, processing signals from the one or more sensors 94, determining whether to actuate a certain valve 12, and/or actuating the multiple valves 12. The storage device(s) (e.g., nonvolatile storage) may include read-only memory (ROM), flash memory, a hard drive, or any other suitable optical, magnetic, or solid-state storage medium, or a combination thereof. The storage device(s) may store data (e.g., characteristics of the hydraulic fluid, thresholds, etc.), instructions (e.g., software or firmware for processing the signals, actuating the valves 12, etc.), and any other suitable data.

In some embodiments, some or all of the multiple valves 12 may be fail-closed valves. In some such embodiments, each of the multiple valves 12 may include a lock 96 (e.g., a mechanical and/or electrical lock, such as a low-powered clutch) that is configured to hold the valve 12 in the open position. In some embodiments, the lock 96 may be connected to the power supply 88, although the connection is not shown in FIG. 2 for image clarity. In operation, a relatively higher amount of power may be provided to the motor 34 of the drive assembly 32 to drive or force the valve 12 to the open position against a biasing member (e.g., spring) associated with the valve 12, and a relatively lower amount of power may then be provided to the lock 96 to hold the valve 12 in the open position. Such a configuration enables the valve 12 to remain in the open position using a relatively lower amount of power and/or even after the drive assembly 32 is withdrawn or separated from the valve 12, while also enabling the biasing member to automatically return the valve 12 to the closed position upon interruption in the power supply. Thus, the valve 12 may be a fail-closed valve and/or may be adjusted from the open position to the closed position by interrupting or turning off the power supply to the lock 96. Together, the drive assembly 32 and the respective lock 96 may form an actuator for each valve 12 (e.g., an actuator that drives the valve 12 from the closed position to the open position and maintains the valve 12 in the open position 12), and the actuator system 30 may include one drive assembly 32 that is configured to work in conjunction with multiple locks 96 to actuate the multiple valves 12. Thus, one part of the actuator (e.g., the drive assembly 32) may be shared between multiple valves 12, while another part of the actuator (e.g., the lock 96) may be associated with or coupled to each of the multiple valves 12.

Figure 3:
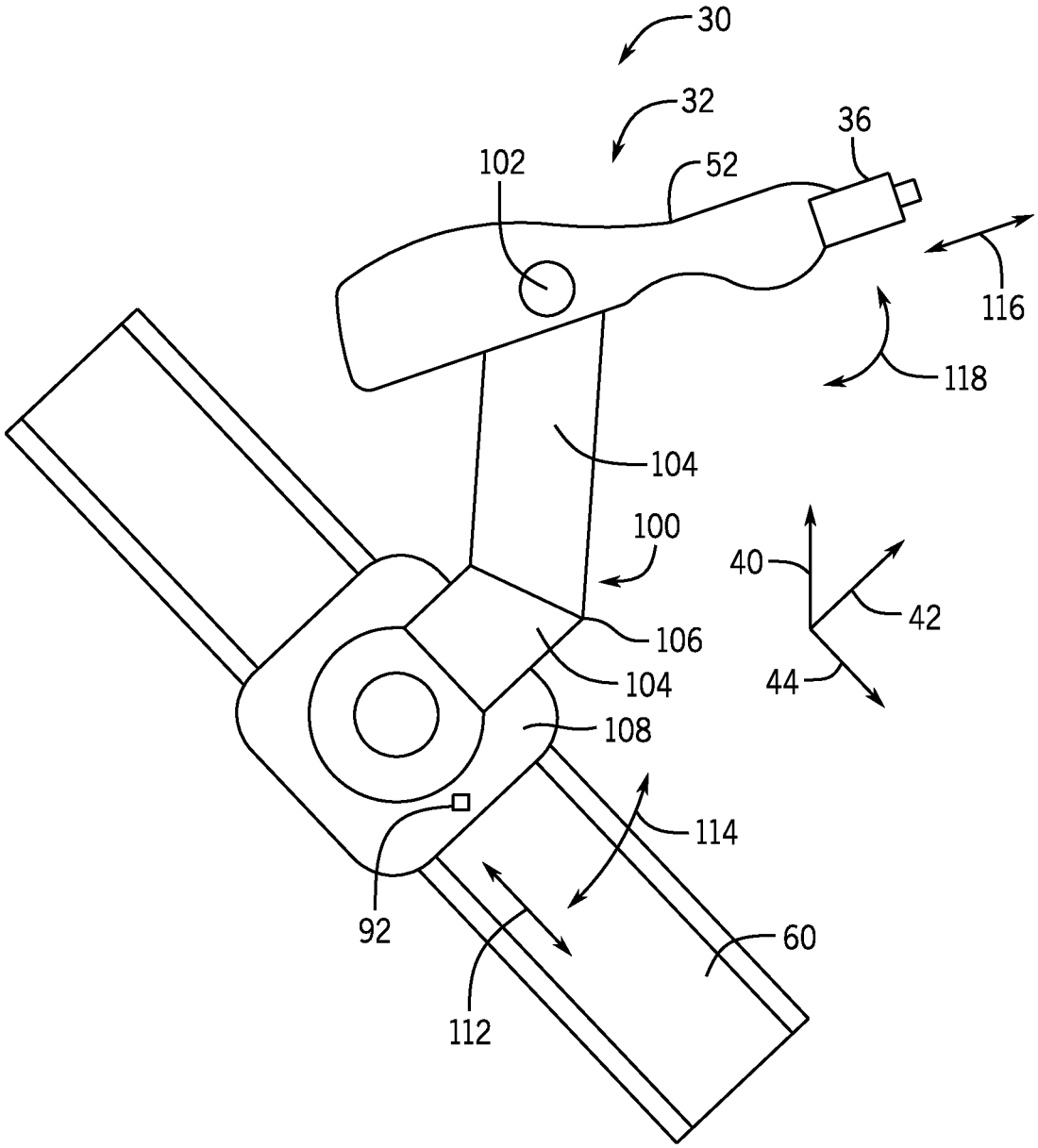
FIG. 3 is a perspective view of an embodiment of a drive assembly having an articulating arm that may be utilized as part of an actuator system to actuate the multiple valves of FIG. 1.

FIG. 3 is a perspective view of an embodiment of the drive assembly 32 with an articulating arm 100 (e.g., jointed arm, adjustable arm, or robotic arm). As shown, the drive assembly 32 includes the housing 52 that supports the motor 34 (shown in FIG. 1) and the valve attachment 36 that extends from the housing 52. In the illustrated embodiment, the housing 52 is coupled (e.g., pivotally coupled) to the articulating arm 100 (e.g., via a hinge or pivot 102), which may include any suitable number of sections 104 coupled (e.g., pivotally coupled) to one another (e.g., via respective hinges or pivots 106) to enable movement of the drive assembly 32 to actuate the multiple valves 12. As shown, the articulating arm 100 is coupled (e.g., pivotally coupled) to a platform or base 108 supported on a track 110 (e.g., frame, bracket, or rail). The track 110 may be in a fixed position relative to the multiple valves 12, and the track 110 may have the same or similar features as the frame 60 and/or the bracket 62 of FIG. 2. In some embodiments, the base 108 may configured to move (e.g., slide) along the track 110, as shown by arrow 112, and/or the base 108 may be configured to rotate relative to the track 110, as shown by arrow 114. A drive system (e.g., additional motors 92) may be provided at various locations to drive movement of the base 108 relative to the track 110 and/or to drive movement of the articulating arm 100 and/or other components of the drive assembly 32 to facilitate actuation of the multiple valves 12.

In operation, once the drive assembly 32 is aligned with one of the multiple valves 12, power may be provided to the motor 34 to drive the valve attachment 36 to actuate the one of the multiple valves 12, as described above with respect to FIG. 2. The drive assembly 32 may be configured to actuate the multiple valves 12 via linear motion of the valve attachment 36 (e.g., in the direction of arrow 116), although it should be understood that in some embodiments, the drive assembly 32 may be configured to additionally or alternatively actuate the multiple valves 12 via rotational motion of the valve attachment 36 or other actuation component (e.g., in the direction of arrow 118). The drive assembly 32 shown in FIG. 3 may be utilized as part of the actuator system 30 and may be controlled via the control system 80 in the manner described above with respect to FIG. 2, for example.

Figure 4:
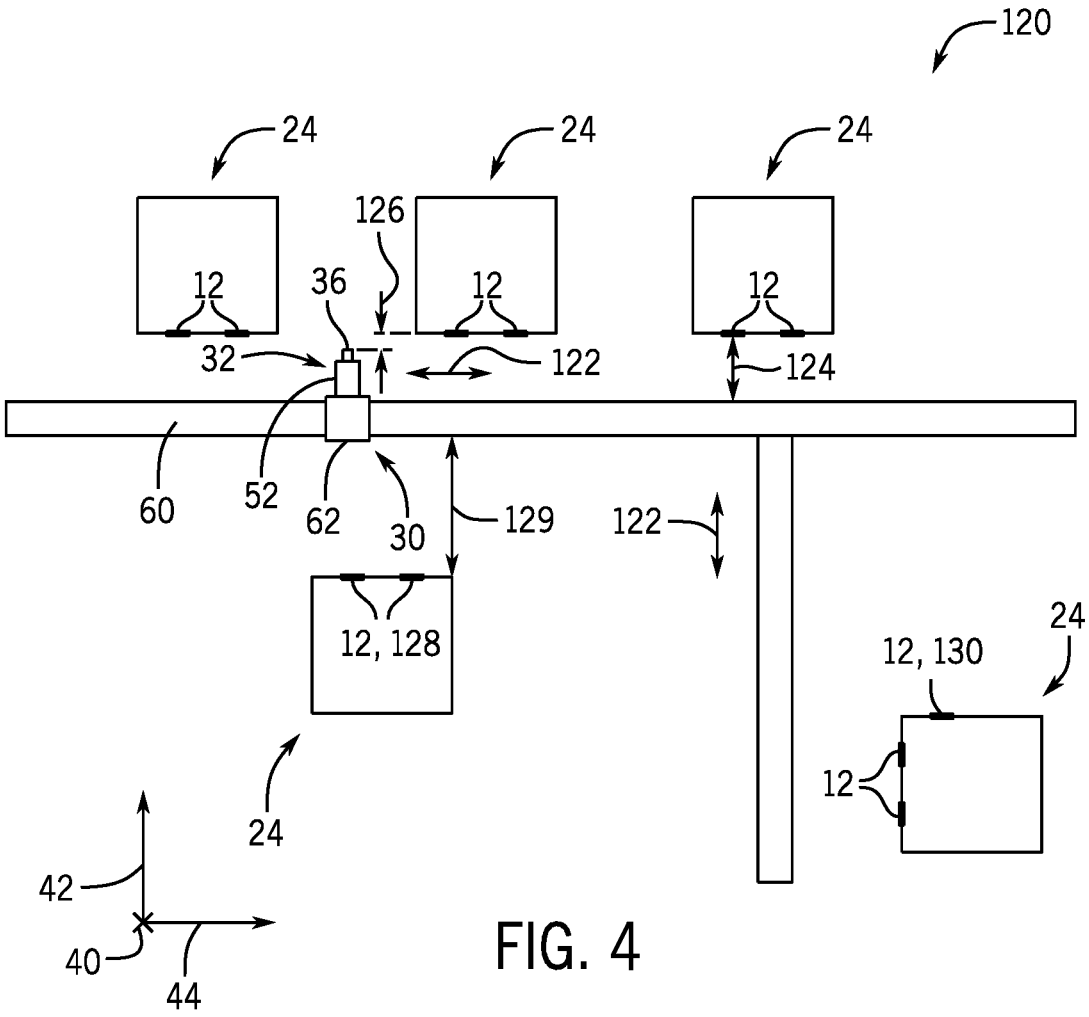
FIG. 4 is a schematic diagram of an embodiment of a production field having an actuator system that may be utilized to actuate multiple valves at various locations within the production field.

FIG. 4 is a schematic diagram of an embodiment of a production field 120 having the actuator system 30 that may be utilized to actuate multiple valves 12 at various locations within the production field 120. As shown, the production field 120 includes multiple trees 24, which each support multiple valves 12. The drive assembly 32 is supported on the frame 60 and may be configured to move (e.g., slide) along the frame 60, as shown by arrows 122. Thus, a single drive assembly 32 may be utilized to actuate the multiple valves 12 on multiple trees 24 or any of a variety of other equipment within the production field 120. In the illustrated embodiment, the multiple valves 12 are aligned in a plane (e.g., parallel to the longitudinal axis 44) to facilitate actuation of each of the multiple valves 12 and/or each of the multiple valves 12 are positioned a first distance 124 from the frame 60 along the lateral axis 42. Thus, once the drive assembly 32 is aligned with a particular valve 12 along the vertical axis 42 and the longitudinal axis 44, the valve attachment 36 moves through a second distance 126 along the lateral axis 46 to engage and/or to actuate the valve 12, and the second distance 126 is the same for each of the multiple valves 12.

In some embodiments, the drive assembly 32 may be configured to actuate valves 12, 128 that are positioned at another distance 129 from the frame 60. In some such cases, the drive assembly 32 may drive the valve attachment 36 through a corresponding distance along the lateral axis 46 to actuate the valves 12, 124. Additionally or alternatively, the drive assembly 32 may be mounted on the rotatable base plate 108 and/or may include the articulating arm 100. Such features may enable the drive assembly 32 to actuate valves positioned at various distances and/or orientations relative to the frame 60, such as the illustrated valve 12, 130.

Figure 5:
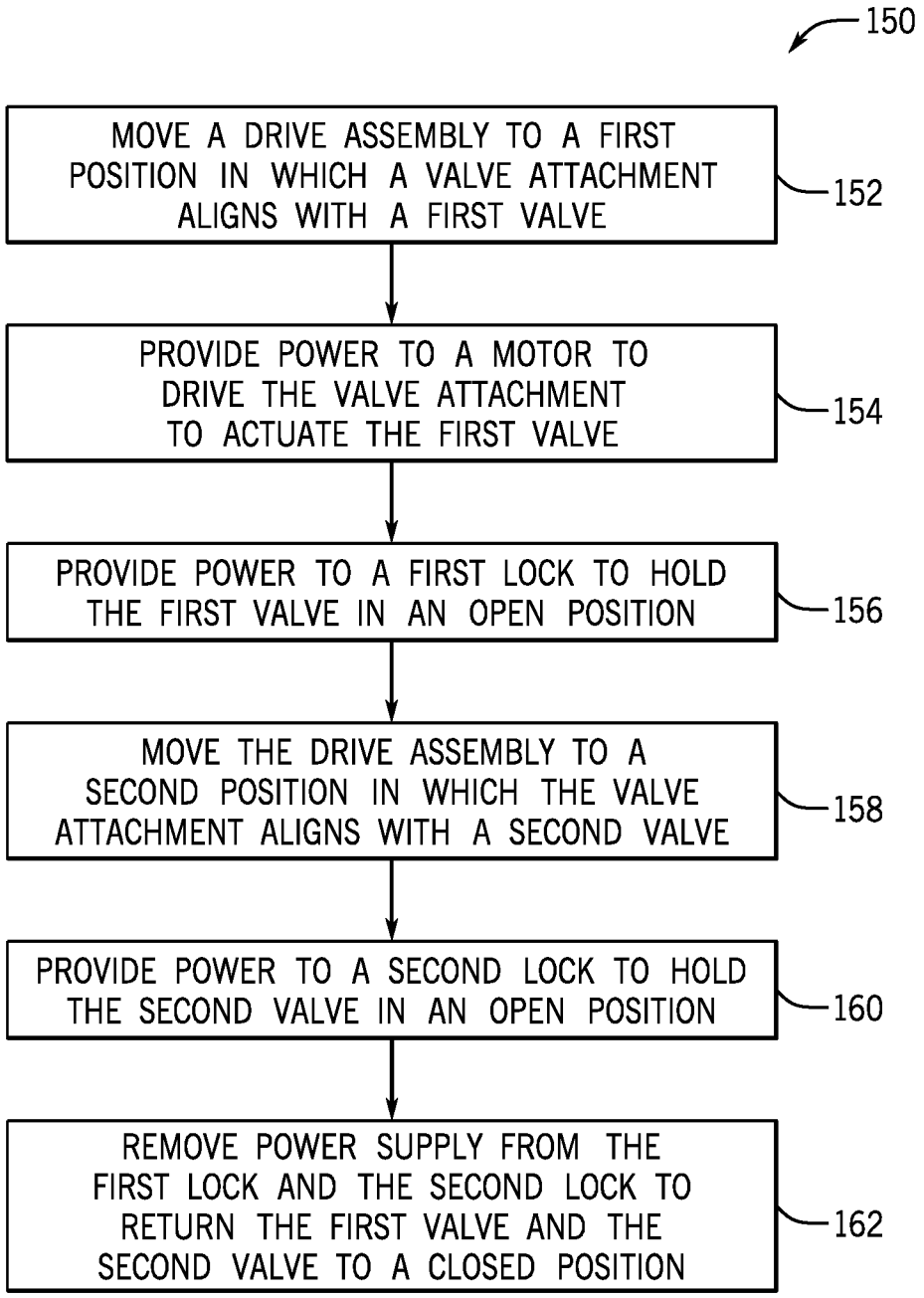
FIG. 5 is an embodiment of a method of operating an actuator system to actuate the multiple valves of FIG. 1.

FIG. 5 is an embodiment of a method 150 of operating the actuator system 30 to actuate the multiple valves 12. The method 150 includes various steps represented by blocks. It should be noted that the method 150 may be performed as an automated procedure by a system, such as the actuator system 30. Although the flow chart illustrates the steps in a certain sequence, it should be understood that the steps may be performed in any suitable order and certain steps may be carried out simultaneously, where appropriate. Further, certain steps or portions of the method 150 may be omitted and other steps may be added. The method 150 may be carried out periodically (e.g., based on instructions stored in a memory device, such as the memory device 86), in response to operator input (e.g., via the input device 90), in response to sensor data (e.g., via the one or more sensors 94), or the like. It should be understood that the method 150 may be adapted to actuate multiple valves 12 of any a variety of components within mineral extraction systems.

The method 150 may begin by moving (e.g. sliding) the drive assembly 32 relative to the multiple valves 12 to align the valve attachment 36 of the drive assembly 32 with the corresponding component 54 of a first valve of the multiple valves 12 along the vertical axis 42 and the longitudinal axis 44, in step 152. As discussed above, the drive assembly 32 may be supported on the bracket 62, the frame 60, and/or the track 110. To move the drive assembly 32, the controller 82 may provide a control signal to provide power from the power source 88 to a drive system (e.g., motors 92) that are configured to drive the drive assembly 32 along the bracket 62 or to move other components of the actuator system 30 relative to one another, for example.

In step 154, once the valve attachment 36 is aligned with the first valve of the multiple valves 12, the controller 82 may provide a control signal to provide power from the power source 88 to the motor 34 to drive the valve attachment 36 (e.g., in the lateral direction 46) to engage and to actuate the corresponding component 54 of the first valve of the multiple valves 12. In some embodiments, the drive assembly 32 may be utilized to move the first valve from the closed position to the open position, and the first valve may then be maintained in the open position via a respective lock 96 (e.g., first lock). Accordingly, in step 156, power may be provided to the first lock 96 associated with the first valve of the multiple valves 12 to maintain the first valve in the open position.

In step 158, the drive assembly 32 may move to a second position in which the valve attachment 36 aligns with a second valve of the multiple valves 12 along the vertical axis 42 and the longitudinal axis 44 in a similar manner as discussed above with respect to step 152. In some embodiments, power may be provided to a respective lock 96 (e.g., second lock) associated with the second valve of the multiple valves 12 to maintain the second valve in the open position after the drive assembly 32 is withdrawn from the second valve, in step 160.

In step 162, the first valve and the second valve of the multiple valves 12 may be moved from the open position to the closed position simultaneously upon an interruption in power supply to the first lock 96 and the second lock 96. It should be understood that, in some embodiments, the drive assembly 32 may be operated to adjust the multiple valves 12 from the open position to the closed position instead of or as an alternative to using the locks 96. The disclosed embodiments may facilitate efficient valve operation, facilitate control of valves from a remote location, reduce actuator and/or operating costs, and/or provide a compact actuation system, thereby reducing space requirements for surface and/or stack equipment. The disclosed embodiments may further eliminate the use of hydraulic fluid for valve actuation, thereby reducing release of hydraulic fluid into the environment.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a valve actuation system configured to selectively actuate a plurality of valves of a mineral extraction system, wherein the valve actuation system comprises:

a support structure configured to be positioned at a fixed location relative to the plurality of valves, wherein the support structure comprises a first bar extending along a first bar axis between different positions of the plurality of valves;

a bracket movably coupled to the first bar along a first path of travel along the first bar axis of the first bar to enable movement closer to one of the different positions of the plurality of valves, wherein the bracket comprises a rod extending along a rod axis crosswise to the first bar axis: and a drive assembly movably coupled to the rod along a second path of travel along the rod axis of the rod to enable movement closer to one of the different positions of the plurality of valves, wherein the drive assembly comprises a valve attachment configured to move along a third path of travel relative to the rod and to actuate the one of the plurality of valves.

2. The system of claim 1, wherein the valve actuation system comprises one or more motors coupled to a controller, wherein the controller comprises a processor, a memory, and instructions stored on the memory and executable by the processor to control the one or more motors to move the bracket along the first path of travel, to move the drive assembly along the second path of travel, and to move the valve attachment along the third path of travel to selectively actuate each of the plurality of valves at the different positions.

3. The system of claim 2, wherein the controller has instructions stored on the memory and executable by the processor to control movement of the valve attachment along the third path of travel to actuate at least one valve of the plurality of valves to move from a closed position to an open position, and to control a lock of the at least one valve to hold the at least one valve in the open position in response to sensor data received at the controller, wherein the sensor data is obtained via one or more sensors and is indicative of one or more characteristics of a fluid.

4. The system of claim 2, wherein at least one valve of the plurality of valves comprises a spring that biases the at least one valve toward a closed position, wherein the controller has instructions stored on the memory and executable by the processor to control movement of the valve attachment along the third path of travel to actuate the at least one valve of the plurality of valves to move from the closed position to an open position overcoming a biasing force of the spring.

5. The system of claim 2, wherein the one or more motors comprise electric motors driven by an electric power source.

6. The system of claim 2, comprising the mineral extraction system having the plurality of valves and the valve actuation system.

7. The system of claim 6, wherein the controller has instructions stored on the memory and executable by the processor to control the one or more motors to automatically move the bracket, the drive assembly, and the valve attachment to actuate the plurality of valves at the different positions in a predetermined sequence at predetermined times in response to sensor data received at the controller, wherein the sensor data is obtained via one or more sensors of the mineral extraction system.

8. The system of claim 6, wherein the mineral extraction system comprises a first production tree positioned at a first location within a field and comprising a first valve of the plurality of valves, and a second production tree positioned at a second location within the field and comprising a second valve of the plurality of valves.

9. The system of claim 2, wherein the controller has instructions stored on the memory and executable by the processor to instruct a power source to provide a first amount of power to an actuation motor of the one or more motors to move the valve attachment to actuate the one of the plurality of valves to move from a closed position to an open position, and to provide a second amount of power less than the first amount of power to a lock to hold the respective one of the plurality of valves in the open position.

10. The system of claim 1, wherein the third path of travel comprises a linear path of travel of the valve attachment.

11. The system of claim 1, wherein the third path of travel comprises a rotational path of travel of the valve attachment.

12. The system of claim 1, comprising an articulating arm having the drive assembly, wherein the articulating arm comprises at least one axis of rotation.

13. The system of claim 1, wherein at least one valve of the plurality of valves comprises a lock having a biasing member that is configured to enable automatic return of the at least one valve from an open position to a closed position upon an interruption in a power from a power source to the at least one lock.

14. The system of claim 1, comprising the plurality of valves, wherein the plurality of valves are aligned in a single plane to facilitate actuation of the plurality of valves by the drive assembly, and the first bar extends linearly along the single plane.

15. The system of claim 1, wherein the support structure comprises a second bar extending along a second bar axis between the different positions of the plurality of valves, wherein the first and second bars are vertically spaced apart from one another, wherein the bracket is movably coupled to the first and second bars along the first path of travel to enable movement closer to one of the different positions of the plurality of valves.

16. A system, comprising:

an actuation system configured to selectively actuate a plurality of components in a mineral extraction system, wherein the actuation system comprises:

a support structure comprising first and second bars spaced vertically apart from one another;

a bracket movably coupled to the first and second bars; and a drive assembly coupled to the bracket, wherein the drive assembly comprises a valve attachment configured to move relative to the bracket to selectively actuate one of the plurality of components.

17. The system of claim 16, wherein the bracket is movably coupled to the first and second bars only along a linear path of travel.

18. The system of claim 16, wherein the actuation system comprises one or more motors coupled to a controller, wherein the controller comprises a processor, a memory, and instructions stored on the memory and executable by the processor to control the one or more motors to move the bracket along a first path of travel along the first and second bars, to move the drive assembly along a second path of travel along the bracket, and to move the valve attachment along a third path of travel to selectively actuate each of the plurality of components at the different positions.

19. A method, comprising:

controlling movement of a valve actuator along a first stationary bar of a stationary structure only in a linear direction between a plurality of valves of a mineral extraction system at a plurality of different positions, wherein controlling movement comprises selectively positioning the valve actuator by at least one valve of the plurality of valves;

controlling movement of a valve attachment of the valve actuator to actuate the at least one valve of the plurality of valves; and wherein the stationary structure comprises a second stationary bar vertically offset from the first stationary bar, comprising controlling movement of the valve actuator via a bracket movably coupled along the first and second stationary bars only in the linear direction, further comprising controlling movement of the valve actuator along the bracket in a direction crosswise to the linear direction.

* * * * *